US009080315B2

(12) United States Patent
Jonninen et al.

(10) Patent No.: US 9,080,315 B2
(45) Date of Patent: Jul. 14, 2015

(54) HEAVY MACHINE-OPERATED SIEVE SCREEN BUCKET

(71) Applicant: Allu Finland Oy, Pennala (FI)

(72) Inventors: Markku Jonninen, Lohilahti (FI); Antti Rautamies, Pennala (FI)

(73) Assignee: Allu Finland Oy, Pennala (FI)

( * ) Notice: Subject to any disclaimer, the term of this patent is extended or adjusted under 35 U.S.C. 154(b) by 0 days.

(21) Appl. No.: 14/190,704

(22) Filed: Feb. 26, 2014

(65) Prior Publication Data

US 2014/0262976 A1 Sep. 18, 2014

(30) Foreign Application Priority Data

Mar. 14, 2013 (FI) ..... 20135247

(51) Int. Cl.

| | |
|---|---|
| ***E02F 3/40*** | (2006.01) |
| ***B07B 1/12*** | (2006.01) |
| ***E02F 3/407*** | (2006.01) |
| ***B07B 1/15*** | (2006.01) |
| ***B02C 18/14*** | (2006.01) |
| ***E02F 7/06*** | (2006.01) |
| ***B07B 1/54*** | (2006.01) |

(52) U.S. Cl.

CPC ..... *E02F 3/407* (2013.01); *B02C 18/142* (2013.01); *B07B 1/12* (2013.01); *B07B 1/15* (2013.01); *B07B 1/54* (2013.01); *E02F 3/401* (2013.01); *E02F 7/06* (2013.01)

(58) Field of Classification Search

CPC ..... E02F 3/407; E02F 37/06; E02F 3/40; B07B 1/12; B07B 1/15; B02C 18/142

USPC ..... 209/671, 672, 674, 667; 37/444, 403, 37/142.5

See application file for complete search history.

(56) References Cited

U.S. PATENT DOCUMENTS

| | | | | |
|---|---|---|---|---|
| 6,375,012 | B1 * | 4/2002 | Leyland et al. | 209/421 |
| 7,913,430 | B2 * | 3/2011 | Mannikko | 37/403 |
| 8,360,249 | B1 | 1/2013 | Currey | |
| 8,893,409 | B1 * | 11/2014 | Rossi, Jr. | 37/444 |

FOREIGN PATENT DOCUMENTS

DE 202006001257 U1 3/2006

OTHER PUBLICATIONS

Search Report for Finnish Patent Application No. 20135247, dated Jan. 13, 2014, Finnish Patent and Registration Office, Helsinki, Finland.

* cited by examiner

*Primary Examiner* — Luis A Gonzalez
(74) *Attorney, Agent, or Firm* — Sterne, Kessler, Goldstein & Fox P.L.L.C.

(57) ABSTRACT

The invention relates to a heavy machine-operated sieve screen bucket. A plurality of screening plates (3) are spaced from each other and establish a screening surface (2), which is provided with screening slots and on top of which the material to be screened can be placed. There are rotatable shafts (4) below the screening surface (2). The shafts (4) are provided with blades (5), which are projecting from the shafts and which extend through the screening slots to above the screening surface (2). The blades (5) taper in a wedge-like manner towards their rounded tips. Side edges of the blades (5) are substantially straight and the angle between the same is in the range of 20-28°.

17 Claims, 3 Drawing Sheets

HEAVY MACHINE-OPERATED SIEVE SCREEN BUCKET

The invention relates to a heavy machine-operated sieve screen bucket, comprising:

a plurality of screening plates, spaced from each other and establishing a screening surface which is provided with screening slots and on top of which can be placed the material to be screened rotatable shafts below the screening surface, and blades which project from the shafts and extend through the screening slots to above the screening surface.

Such a sieve screen is known from the Applicant's German utility model DE 202006001257 U1. This prior known piece of equipment provides a good separating capability and high capacity with respect to other sieve screens available in the marketplace. Also, the screen obstruction problems are avoided even with wet materials and, if necessary, even small fraction sizes can be screened. However, this prior known sieve screen involves a drawback in that the angle of incidence between the rotating blades and the material is not optimal on all occasions, but some materials exhibit a tendency of sticking or unnecessary crushing of the screened material. This hinders operation and leads to needless consumption of power.

It is an object of the invention to obviate this drawback and to provide a sieve screen bucket of the above-mentioned type, which enables to retain the benefits of a sieve screen known from the DE utility model and further to reduce the tendency of sticking and unnecessary crushing of the material being screened.

This object is attained in the invention with a sieve screen bucket presented in the appended claim 1. The dependent claims present preferred embodiments of the invention.

A further object of one preferred embodiment of the invention is to enable an easy maintenance and replacement of components of the sieve screen, or even a replacement of the sieve screen with a crusher.

In a sieve screen of the invention, the screening surface is not moving as opposed to generally known screening methods. The screening surface consists of stationary screening plates and the movement of a material to be screened over the sieve screen or across the sieve screen is achieved with blades rotated by shafts present below the screening surface and extending through the screening surface. This design enables the construction of a robust screening surface, whereby prescreening prior to fine screening is not absolutely necessary. As opposed to methods available in the marketplace, the screening operation can also be activated with the material already on top of the sieve screen, because the driving force required by the blades is hardly dependent on the amount of material on top of the sieve screen but solely on the type of material. Hence, this also enables the screening on a batch principle, such as the use as a bucket machine attachment, wherein material is collected into a bucket and the screening is not started until thereafter. The sieve screen also enables a more efficient use of the screening surface and thereby a higher capacity per screening area than methods based solely on gravity, since the fine material is forced by means of rotating blades rapidly through the sieve screen, whereby the throughput time can be influenced by the speed of the blades and the power to be applied. This makes it possible to manufacture high capacity compact sieve screens.

One exemplary embodiment of the invention will now be described more closely with reference to the accompanying drawings, in which FIG. 1 shows a sieve screen bucket of the invention in cross-section, in attachment with an excavator bucket 1.

Figure 1:
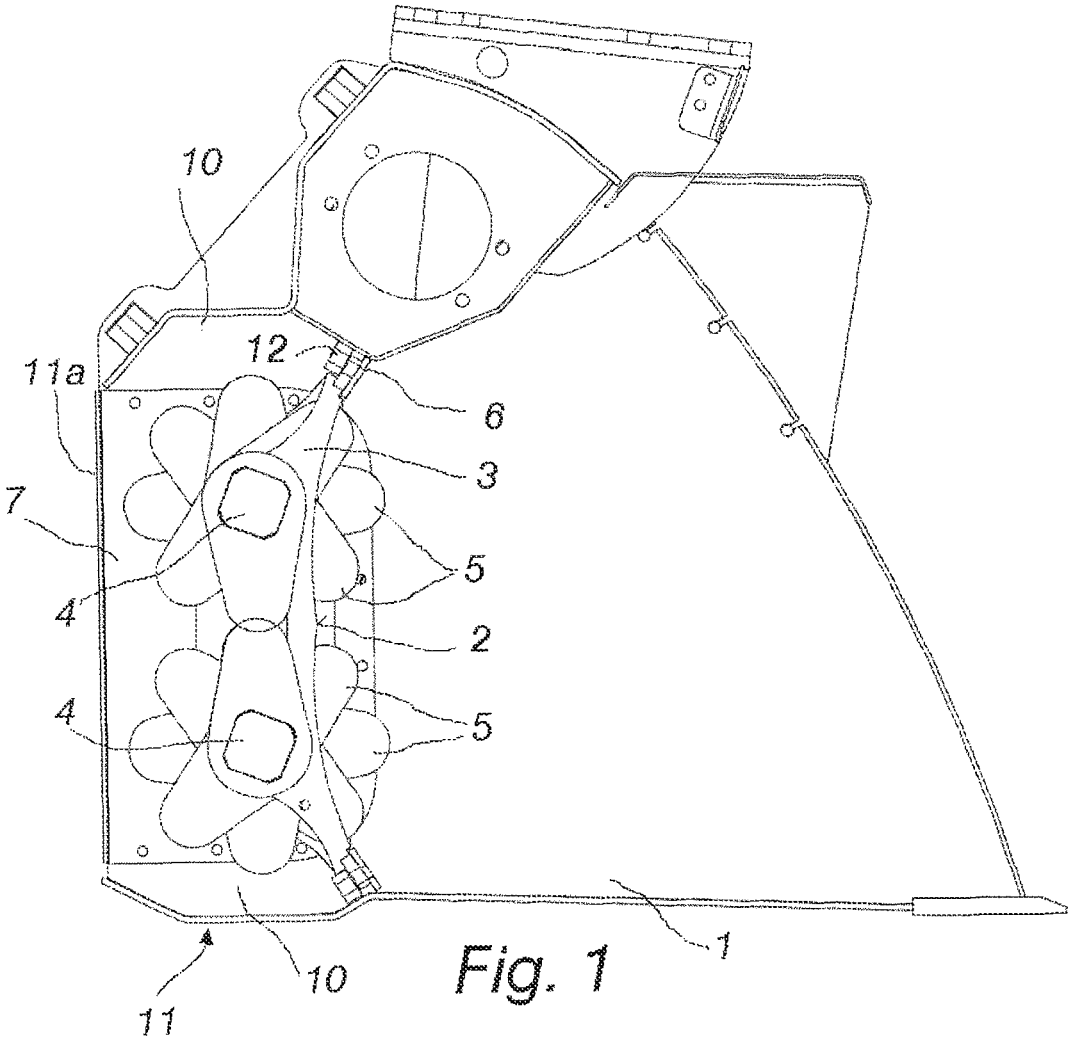
Figure 2:
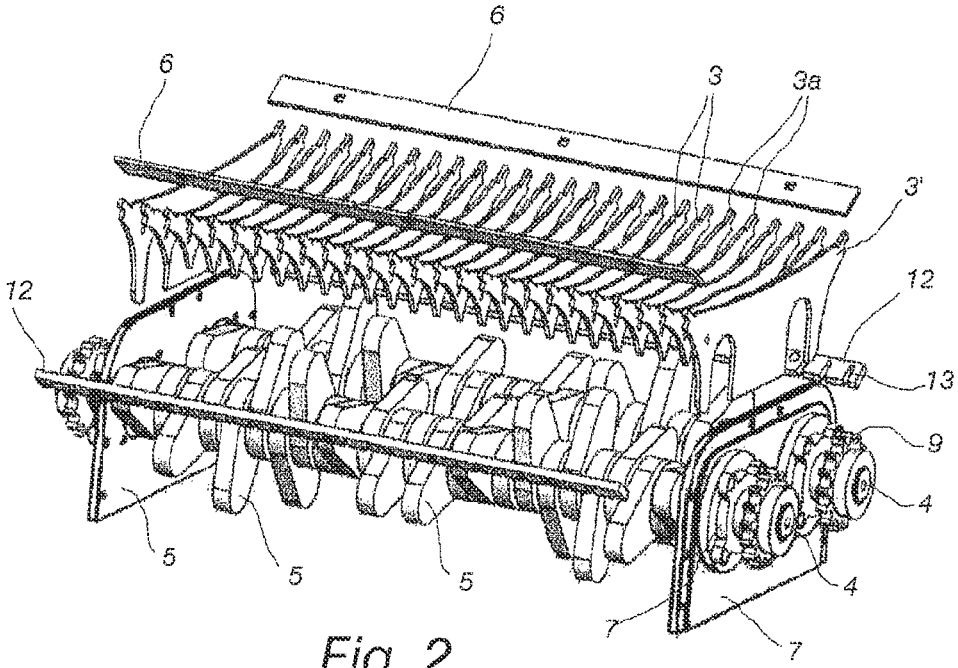
FIG. 2 shows a sieve screen for the sieve screen bucket of FIG. 1, in detachment from the bucket. A sieve screen cartridge unit is capable of being installed in the bucket across an open rear side of the bucket.
Figure 3:
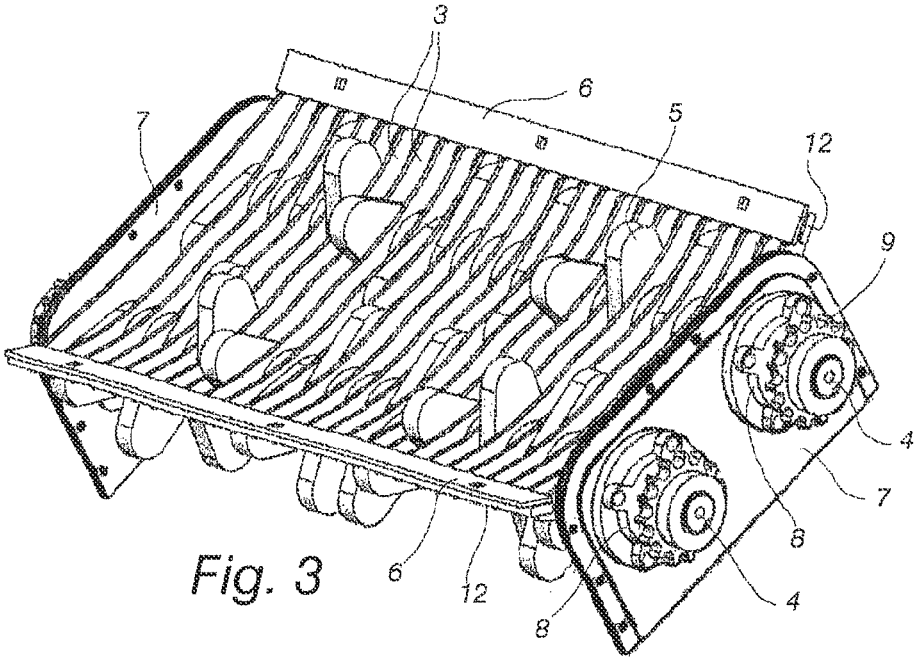
FIG. 3 shows the sieve screen of FIG. 2 in an assembly drawing.

The sieve screen according to the invention comprises a screening surface provided with slots, on top of which can be placed a material to be screened. The screening surface is constructed in such a way that the ends of separate screening plates 3 are fixed between flat bars 6 and 12 which retain the screening plates 3 at a distance from each other matching the screening slot. In the present case, the flat bars 6 and 12 extend continuously across the entire length of an edge of the screening surface 2, but the flat bars can also be divided into several sections. The flat bars 6 and 12 are attachable to the fastening lips of a bucket frame. The screening plates 3 are as thin as possible from the standpoint of structural strength, thus providing a maximal capacity per unit area of the screening surface. The screening slots extend continuously across the entire distance between the flat bars 6, thus avoiding the formation of unnecessary obstacles to the material follow-through.

Present below the screening surface 2 are rotatable shafts 4, fitted with projecting blades 5 which rotate along with the shafts 4 and extend through the screening slots to above the screening surface 2. The blades 5 have an extent in the range of 1-40 mm above the screening surface 2. With this dimensioning of blades, the blades are on the one hand enabled to convey through the sieve screen a material capable of fitting in the screening slots and, on the other hand, to push along the screening surface a material not fitting in the slots. In a preferred embodiment of the invention, the screening plates can be adjustable in the direction perpendicular to a plane surface extending by the shafts 4 for changing the extent of protrusion of the blades 5 above the screening surface 2. The inter-shaft distances and the length of the blades 5 are preferably dimensioned in such a way that the entire volume of screening slots between the screening plates 3 will be swept by the blades 5. Thereby, between the plates 3 remain no blind spots for the material to stick. Small blind spots can be tolerated, since, outside these spots, the blades 5 in any event take care of maintaining the sieve screen in a continuously open condition. Therefore, the only drawback of small blind spots is a slight reduction of the sieve screen capacity per unit area in case the blind spots are obstructed.

Both shafts 4 are driven in the same direction, whereby the material not fitting in the sieve screen is continuously revolving in the same direction instead of building a plug on top of the screening surface. After the screening, the only items left inside the sieve screen bucket 1 are rocks or other hard pieces incapable of passing through the sieve screen.

In a preferred embodiment of the invention, the blades 5 are freely movable on the shafts 4 in axial direction. All that is transmitted by the shafts 4 to the blades 5 is a torque. The shafts 4 are polygonal in cross-section, and each blade 5 has a collar element 5*a*, which extends around the shaft and from which projects the actual blade 5. Accordingly, the blade 5 in all of its rotational positions, i.e. at all of the rotational angles of the shaft 4, lies at least partially between the screening plates 3 under control of the screening plates. Hence, the screening plates 3 retain a position perpendicular to the screening surface 2. Thus, the blades 5 are sort of like slabs having a thickness which is substantially equal to the width of a screening slot between the screening plates 3.

The distance between the shafts 4 is slightly less than the diameter of a circle drawn by a tip of the blade 5. Thus, the parallel shafts 4 must have the positions of their blades synchronized in such a way that the ends of the blades 5 do not coincide in the same slot. In FIG. 1 there is intentionally shown an incorrect position, wherein the ends of the blades are overlapped, i.e. would collide with each other unless said positional synchronization were present.

In order to have the slots between the plates swept by the blades 5 without substantial blind spots, and without having to reduce the inter-shaft distance such that the synchronization of blades would become a problem, it has been realized, in a preferred embodiment of the invention, to construct the screening surface 2 as a downward concave arch and to be slightly undulating. The screening surface has its undulation peak located midway across the inter-shaft distance for increased screening throughput. The undulation valley can have its curvature in the form of a circular arc with its lowest point in line with shaft 4. Thereby is obtained a distribution of material on the screening surface advantageous for effective screening. In addition, it must be taken care of that between a lateral surface of the screening surface-approaching blade 5 and the screening surface be always left a sufficiently large angle, such that hard pieces not fitting in the screening slots become conveyed along the screening surface instead of being jammed between the blade and the screening surface. This is why the blades 5 taper in a wedge-like manner towards their rounded tips. The sides of blades (5) are substantially straight with an angle between the same in the range of 20-28°. This is also partly influenced by the fact that the blade must not extend above the screening surface higher than a certain maximum distance.

The screening plates 3 have their bottom edges provided with recesses for receiving the shafts 4, whereby the screening plates 3 extend partially into a space between the shafts 4. In a loaded condition, the screening plates 3 may be supported in their mid-sections on the shafts 4, i.e. the recesses may have their bottoms leaning against the shafts 4 as necessary.

When using a sieve screen bucket of the invention, the turning motor can be disposed in an enclosure at an upper portion of the bucket, and the rotation drive such as chains and gears can be disposed in an enclosure 11 at a side wall of the bucket. The earth material to be screened is collected into the bucket, and the bucket is turned over to a screening position in which the sieve screen is in a slightly tilted position for the material to be conveyed by the blades 5 on top of the screening surface 2 in a slightly uphill direction. In this case, the material does not become packed at the end in the conveying direction, but circulates on top of the sieve screen until all the material fitting through the sieve screen has vacated the bucket.

Figure 4:
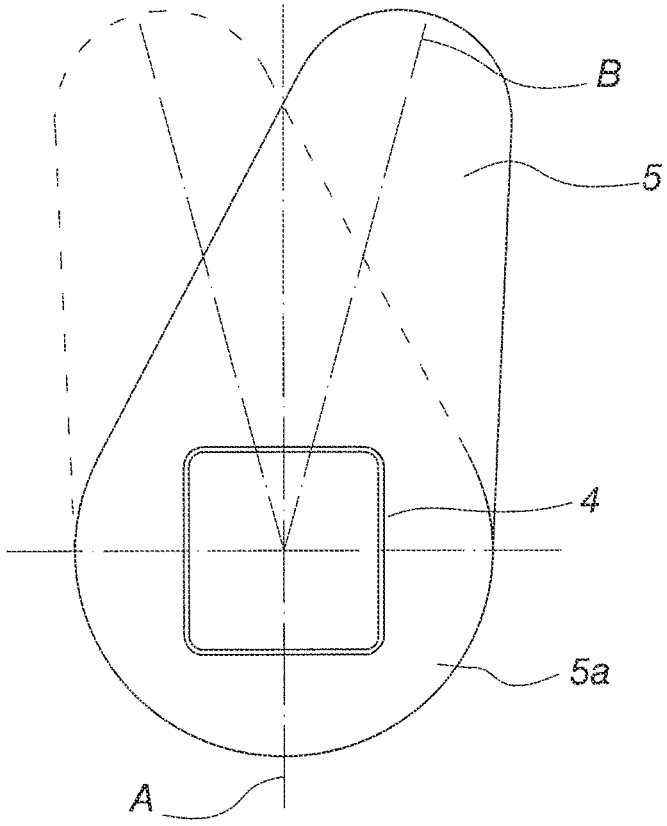
FIG. 4 shows a detail regarding the disposition of a blade 5 on a sieve screen shaft.

FIG. 4 shows in more detail the shape and disposition of a blade 5 on a square-shaped shaft 4. Various angular positions of the blades are used for setting the blades in a spiral fashion on each shaft. The blades 5 can be mounted on the shaft 4 e.g. staggered with an angular spacing of 30° or 45°. The blades 5 can establish around the shaft 4 a spiral pitch such that feeds material from the sides towards the middle of the sieve screen. In other words, the blades 5 are mounted on the shaft 4 in such a way that, when the shafts are rotating in a normal screening direction, the blades rise above the screening surface first from the ends of the shafts and lastly from the middle of the shaft, thus establishing a material centering effect on a top surface of the sieve screen.

Unlike the others, the outermost screening plate 3 is designed to extend deep around and below the shafts 4 adjacent to the penetrations of fastening plates 7. Hence, these screening plates 3 provide mudguards which block the entrance of dirt into penetrations of the fastening plates 7, and thereby to bearings 8 which are mounted on the outer sides of the fastening plates 7.

The fastening plates 7, and the shafts 4, along with their blades 5, fixed (bearing-mounted) thereon, make up a cartridge unit capable of being installed in a single entity from the rear side of the bucket 1 by pushing the fastening plates 7 in the direction of their plane into reception openings in frame plates 10 of the bucket and by securing the fastening plates 7 with bolts to the bucket's frame plates 10. The fastening plates 7 are double-layered, such that the edges develop a staggered fastening flange. The fastening plates 7 make up internal walls for the drive enclosures 11. After installation, the rear sides of the drive enclosures 11 are closed with rear walls 11*a*. The screening plates 3 to be placed between the blades 5 are set in position one by one from a forward side of the bucket. Attached to the bucket frame are elastic flat bars 12 of e.g. elastomer, whose grooves 13 take up ends 3*a* of the screening plates 3 and guide these to their positions. Finally, the screening plates 3 are secured by fixing the flat bars 6 on top of their ends 3*a*.

What is claimed is:

1. A heavy machine-operated sieve screen bucket, comprising:

a plurality of screening plates (3), spaced from each other and establishing a screening surface (2) which is provided with screening slots and on top of which can be placed the material to be screened rotatable shafts (4) below the screening surface (2), and blades (5) which project from the shafts (4) and extend through the screening slots to above the screening surface (2), characterized in that the blades (5) taper in a wedge-like manner towards their rounded tips; and characterized in that the side edges of the blades (5) are substantially straight and the angle between the side edges is in the range of 20-28°.

2. A heavy machine-operated sieve screen bucket, comprising:

a plurality of screening plates (3), spaced from each other and establishing a screening surface (2) which is provided with screening slots and on top of which can be placed the material to be screened rotatable shafts (4) below the screening surface (2), and blades (5) which project from the shafts (4) and extend through the screening slots to above the screening surface (2), characterized in that the blades (5) taper in a wedge-like manner towards their rounded tips; and characterized in that the slots between the blades are larger than the thickness of the screening plates (3) by a sliding clearance, and that the screening plates (3) extend into spaces between the blades (5).

3. The sieve screen bucket as set forth in claim 1 or claim 2, characterized in that the ends of the screening plates (3) are located in an elastic flat bar's (12) grooves (13), the distance between which matches the distance between screening plates and respectively the size of a screening slot.

4. The sieve screen bucket as set forth in claim 1, characterized in that fastening plates (7), and the shafts (4), along with their blades (5), mounted thereon with bearings (8), make up a cartridge unit capable of being installed in a single entity from a rear side of the bucket (1) by pushing the fastening plates (7) in the direction of their plane into reception openings in frame plates (10) of the bucket.

5. The sieve screen bucket as set forth in claim 4, characterized in that the bearings (8) of the shafts (4) are mounted on outer sides of the fastening plates (7), and the fastening plates (7) make up the internal walls of drive enclosures (11).

6. The sieve screen bucket as set forth in claim 5, characterized in that the outermost screening plates (3') extend deep below the shafts (4) adjacent to penetrations of the fastening plates (7), thus establishing mudguards which impede the entrance of dirt through the penetrations to the bearings (8).

7. The sieve-screen bucket of claim 1, characterized in that the slots between the blades are larger than the thickness of the screening plates (3) by a sliding clearance, and that the screening plates (3) extend into spaces between the blades (5).

8. The sieve screen bucket as set forth in claim 7, characterized in that the ends of the screening plates (3) are located in an elastic flat bar's (12) grooves (13), the distance between which matches the distance be-tween screening plates and respectively the size of a screening slot.

9. The sieve screen bucket as set forth in claim 8, characterized in that fastening plates (7), and the shafts (4), along with their blades (5), mounted thereon with bearings (8), make up a cartridge unit capable of being installed in a single entity from a rear side of the bucket (1) by pushing the fastening plates (7) in the direction of their plane into reception openings in frame plates (10) of the bucket.

10. The sieve screen bucket as set forth in claim 9, characterized in that the bearings (8) of the shafts (4) are mounted on outer sides of the fastening plates (7), and the fastening plates (7) make up the internal walls of drive enclosures (11).

11. The sieve screen bucket as set forth in claim 10, characterized in that the outermost screening plates (3') extend deep below the shafts (4) adjacent to penetrations of the fastening plates (7), thus establishing mudguards which impede the entrance of dirt through the penetrations to the bearings (8).

12. The sieve screen bucket as set forth in claim 3, characterized in that fastening plates (7), and the shafts (4), along with their blades (5), mounted thereon with bearings (8), make up a cartridge unit capable of being installed in a single entity from a rear side of the bucket (1) by pushing the fastening plates (7) in the direction of their plane into reception openings in frame plates (10) of the bucket.

13. The sieve screen bucket as set forth in claim 12, characterized in that the bearings (8) of the shafts (4) are mounted on outer sides of the fastening plates (7), and the fastening plates (7) make up the internal walls of drive enclosures (11).

14. The sieve screen bucket as set forth in claim 13, characterized in that the outermost screening plates (3') extend deep below the shafts (4) adjacent to penetrations of the fastening plates (7), thus establishing mudguards which impede the entrance of dirt through the penetrations to the bearings (8).

15. The sieve screen bucket as set forth in claim 2, characterized in that fastening plates (7), and the shafts (4), along with their blades (5), mounted thereon with bearings (8), make up a cartridge unit capable of being installed in a single entity from a rear side of the bucket (1) by pushing the fastening plates (7) in the direction of their plane into reception openings in frame plates (10) of the bucket.

16. The sieve screen bucket as set forth in claim 15, characterized in that the bearings (8) of the shafts (4) are mounted on outer sides of the fastening plates (7), and the fastening plates (7) make up the internal walls of drive enclosures (11).

17. The sieve screen bucket as set forth in claim 16, characterized in that the outermost screening plates (3') extend deep below the shafts (4) adjacent to penetrations of the fastening plates (7), thus establishing mudguards which impede the entrance of dirt through the penetrations to the bearings (8).

* * * * *